US005220786A

United States Patent [19]

Campbell

[11] Patent Number: 5,220,786

[45] Date of Patent: Jun. 22, 1993

[54] THERMALLY PROTECTED VENTURI FOR COMBUSTOR DOME

[75] Inventor: Thomas C. Campbell, Glendale, Ohio

[73] Assignee: General Electric Company, Cincinnati, Ohio

[21] Appl. No.: 666,312

[22] Filed: Mar. 8, 1991

[51] Int. Cl.[5] ..... F23R 3/32

[52] U.S. Cl. ..... 60/39.32; 60/39.55; 60/740; 60/753

[58] Field of Search ..... 60/748, 737, 743, 39.32, 60/740, 753, 39.55, 39.53; 431/181, 182, 183, 187

[56] References Cited

U.S. PATENT DOCUMENTS

| | | | |
|---|---|---|---|
| 2,665,748 | 1/1954 | Cornelius | 431/181 |
| 3,215,098 | 11/1965 | Nelson | 431/187 |
| 3,922,137 | 11/1975 | Peczeli et al. | 431/183 |
| 3,934,408 | 1/1976 | Irwin | 60/753 |
| 4,222,230 | 9/1980 | Bobo et al. . | |
| 4,271,675 | 6/1981 | Jones et al. . | |
| 4,297,093 | 10/1981 | Morimoto et al. | 431/182 |
| 4,322,945 | 4/1982 | Peterson et al. . | |
| 4,373,342 | 2/1983 | Willis et al. . | |
| 4,567,730 | 2/1986 | Scott | 60/39.32 |
| 4,638,636 | 1/1987 | Cohen . | |
| 4,655,044 | 4/1987 | Dierberger et al. | 60/753 |
| 4,934,145 | 6/1990 | Zeisser . | |
| 4,942,732 | 7/1990 | Pricemen | 60/753 |

FOREIGN PATENT DOCUMENTS

| | | | |
|---|---|---|---|
| 0136071 | 4/1985 | European Pat. Off. | 60/753 |
| 0149474 | 7/1985 | European Pat. Off. | 60/753 |

*Primary Examiner*—Richard A. Bertsch
*Assistant Examiner*—Timothy S. Thorpe
*Attorney, Agent, or Firm*—James P. Davidson; Jerome C. Squillaro

[57] ABSTRACT

In accordance with one aspect of the invention, a venturi having a heat shield along its inner diameter and a thermal barrier coating along its outer diameter is provided, whereby the temperature gradient of the venturi is lowered and metal distress and erosion caused by water injected therethrough is reduced. In an alternate embodiment, a floating insert is placed within an area along the venturi's inner diameter, where it is held in position by a heat shield.

16 Claims, 3 Drawing Sheets

THERMALLY PROTECTED VENTURI FOR COMBUSTOR DOME

BACKGROUND OF THE INVENTION

1. Field of the Invention

The present invention relates to a combustor for a gas turbine engine, and, more particularly, to a thermally protected venturi for the combustor dome of a gas turbine engine.

2. Description of Related Art

In the design of gas turbine engines, it has become important to not only provide a combustor apparatus which is efficient, but one which minimizes emissions as well. One manner of diminishing emissions involves the injection of water into the combustor to reduce the temperature therein, oftentimes through the nozzle circuit utilized for supplying fuel.

In one such combustor design, the nozzle is spaced a distance from the dome area, rather than immediately adjacent thereto. This configuration is utilized to prevent carbon clusters from forming in the nozzle resulting from close proximity to the harsh combustion zone.

Although water injection has been effective in combating emissions, such injection in the aforementioned design has had the undesirable effect of causing metal distress and erosion to the inner diameter of the venturi carrying the injected water to the combustion zone. Since prior art combustors have normally been configured to have the fuel nozzle approximately even with the end of the swirl cup or adjacent to the combustion zone (e.g., U.S. Pat. No. 4,934,145 to Zeisser), this problem is a relatively recent and peculiar occurrence. The cause of thermal distress and erosion to the venturi stems from relatively cold water impinging onto the relatively hot metal surface of the venturi. Water is more punitive than other fluids passing through the venturi because it has a higher coefficient of convective heat transfer and, all else being equal, causes higher thermal stress. This explains why water causes problems, whereas liquid fuel and steam does not.

Accordingly, a primary objective of the present invention is to provide a thermally protected venturi for a combustor which prevents water injected to reduce emissions from causing metal distress and erosion to the inner diameter of the venturi.

Another objective of the present invention is to provide a venturi with a reduced temperature gradient for handling water impinging thereon, thereby reducing exposure to thermal stress and erosion.

Yet another objective of the present invention is to reduce the momentum in which water is swirled in the venturi to lower its impingement intensity and resulting coefficient of convective cooling.

These objectives and other features of the present invention will become more readily apparent upon reference to the following description when taken in conjunction with the following drawing.

SUMMARY OF THE INVENTION

In accordance with one aspect of the invention, a venturi having a heat shield along its inner diameter and a thermal barrier coating along its outer diameter is provided, whereby the temperature gradient of the venturi is lowered and metal distress and erosion caused by water injected therethrough is reduced. In an alternate embodiment, a floating insert is placed within an area along the venturi's inner diameter, where it is held in position by a heat shield.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
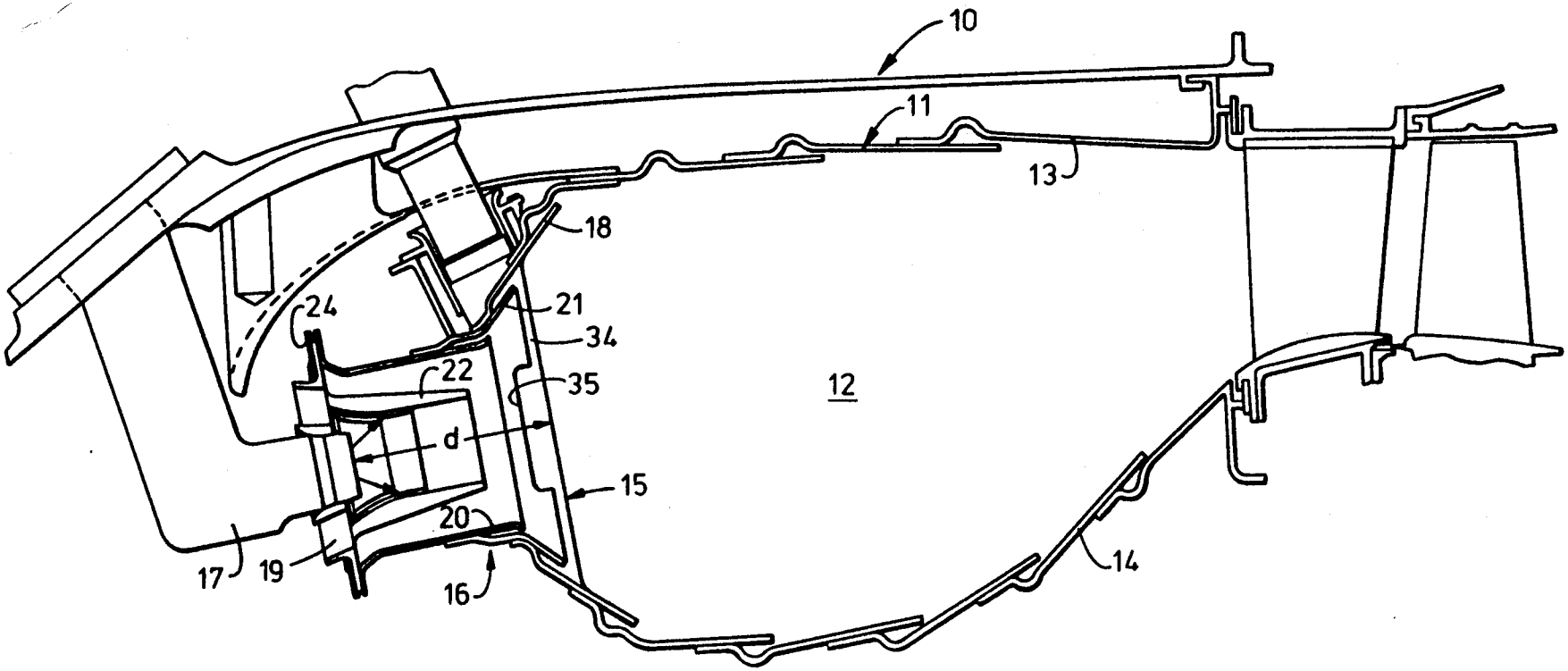
FIG. 1 is a longitudinal sectional view through the combustor structure.

Referring now to the drawings in detail, wherein identical numerals indicate the same elements throughout the Figures, FIG. 1 depicts a continuous-burning combustion apparatus 10 of the type suitable for use in a gas turbine engine and comprising a hollow body 11 defining a combustion chamber 12 therein. Hollow body 11 is generally annular in form and is comprised of an outer liner 13, an inner liner 14, and a domed end or dome 15. It should be understood, however, that this invention is not limited to such an annular configuration and may well be employed with equal effectiveness in combustion apparatus of the well-known cylindrical can or cannular type. In the present annular configuration, the domed end 15 of hollow body 11 includes a swirl cup package 16, having disposed therein a thermally protected venturi 22 of the present invention to allow the injection of water into combustion chamber 12 without causing thermal stress and erosion to venturi 22.

FIG. 1 also depicts a fuel nozzle 17 inserted into swirl cup package 16. Fuel nozzle 17 preferably is a dual cone fuel nozzle, whereby both fuel and water may be provided to combustion chamber 12. In this way, fuel may be ignited in combustion chamber 12 while water reduces the temperature, and consequently, emissions therein. It will be noted in FIG. 1 that fuel nozzle 17 may be spaced a distance d from combustion chamber 12 in order to prevent carbon clusters from forming on the tip surfaces of nozzle 17 resulting from close proximity to combustion chamber 12.

Figure 2:
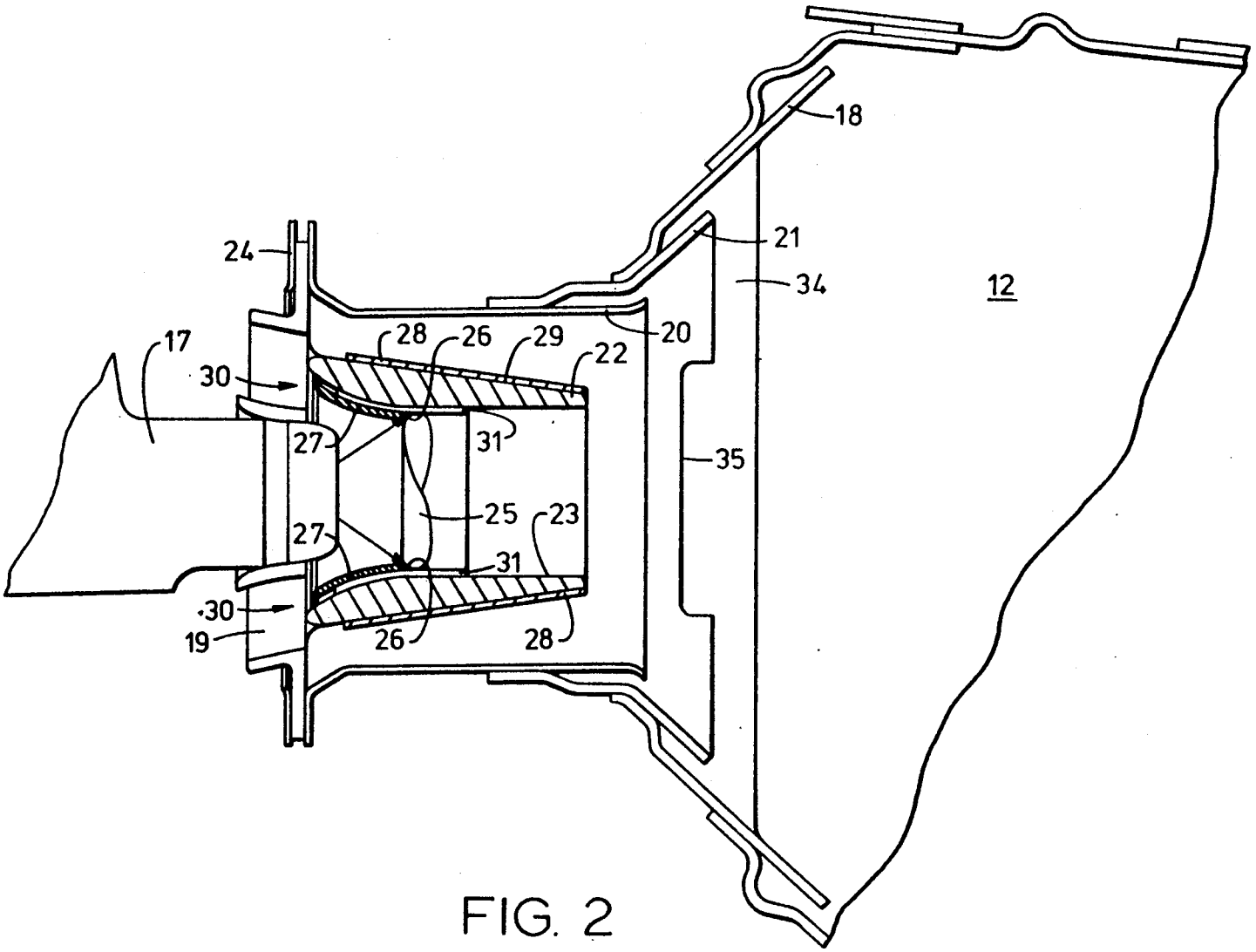
FIG. 2 is an enlarged view of the combustor dome portion of FIG. 1.

As best seen in FIG. 2, combustor dome 15 consists of a single spectacle plate 18, which is generally a die formed sheet metal part. An individual swirl cup package 16 is brazed into spectacle plate 18 and includes therein a swirler 19, a swirl cup 20, a splash plate 21, and a venturi 22. Swirl cup assembly 16 is brazed together with a retainer 24 welded into position on the front surface of swirler 19. A trumpet 34 is depicted in FIGS. 1 and 2 as having a notch 35 in its sides so as to allow water to bypass the sides of trumpet 34.

FIG. 2 illustrates the injection of water and fuel into venturi 22, whereupon it is caused to swirl in a frustoconical manner 25 by air flow through the inner portion of swirler 19 onto and against inner surface 23 at location 26. As noted previously, this relatively cold water (approximate 100° F.) causes metal distress, and in turn erosion and fragmentation. This requires frequent replacement of venturi 22 in order to maintain the necessary dispersement of water and fuel in combustion chamber 12, as well as prevent downstream turbine damage from metal fragmentation loss.

In order to overcome this problem, venturi 22 implements a heat shield 27 and a thermal barrier coating 28 along inner surface 23 and outer surface 29 respectively. These measures act to reduce the temperature gradient (degrees Fahrenheit per inch) of venturi 22 at water impingement location 26 by reducing the heat input to inner surface 23 and heat inflow on outer surface 29 from hot air flowing through swirler 19. For example, the temperature gradient of venturi 22 for liquid fuel has been analyzed to be approximately 2700 degrees Fahrenheit per inch, compared with 3900 degrees Fahrenheit per inch for water spray impingement. Consequently, heat shield 27 and thermal barrier coating 28 are utilized to thermally protect or insulate venturi 22 from the thermal stress caused by the high coefficient of convective heat transfer of the water spray. In particular, it has been found that implementation of heat shield 27 and thermal barrier coating 28 reduces the temperature gradient of venturi 22 as low as 1500 degrees Fahrenheit per inch. This is well within the acceptable limits experienced by venturi 22 with respect to liquid fuel and steam passing therethrough or acceptable similar applications not employing water injection.

With respect to heat shield 27, it is preferably attached at the front end of inner surface 23 by means of a fillet fusion weld 30 or other similar means of localized attachment. Thereafter, heat shield 27 is shaped so as to conform to the contour of inner surface 23, but with no metallurgical attachment to inner surface 23 except at the front end. Thus, conduction of heat from heat shield 27 to inner surface 23 is minimized. Additionally, it will be noted that heat shield 27 needs to extend only partially along inner surface 23, where it is able to limit the effects of the hot air from swirler 19 and its heating thermal effects. However, it is not intended for heat shield 27 to be subject to water spray impingement whereby it could deteriorate and erode. If the spray should impinge upon the end of heat shield 27, however, it will be "self-trimmed" only a minimal amount and continue to provide the intended thermal protection function.

While heat shield 27 is preferably made from a metal, such as HAST X, thermal barrier coating 28 is preferably yttria zirconate. Alternatively, a heat shield like that along inner surface 23 may be utilized along outer surface 29 in place of thermal barrier coating 28.

Figure 3:
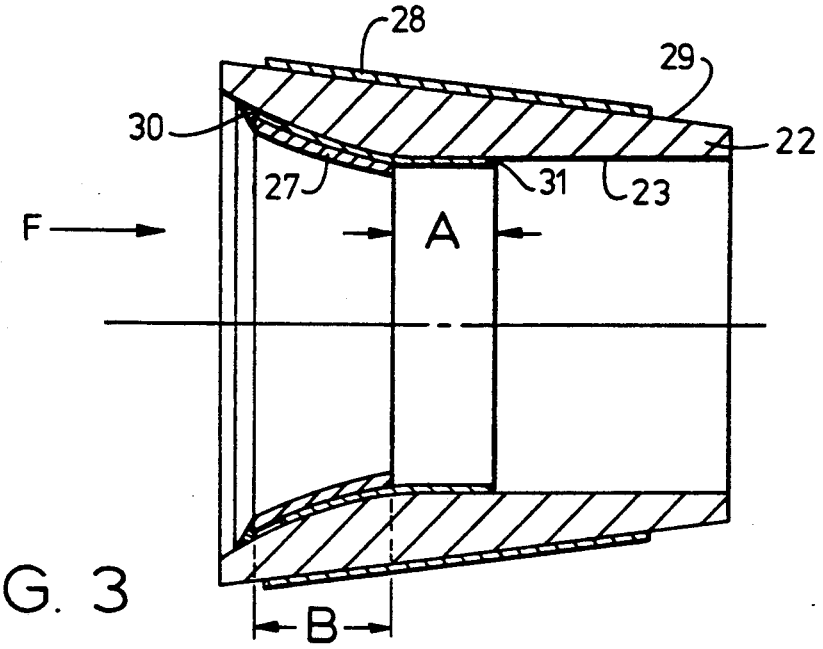
FIG. 3 is an enlarged longitudinal sectional view of the venturi of the present invention.

To further enhance the ability of inner surface 23 to withstand water impingement flowing in the direction of arrow F, coating 31 is preferably provided which both adds to wear and corrosion resistance in area A of venturi 22 and provides additional heat flow resistance between the hot air flowing inside of heat shield 24 and venturi 22 in area B (see FIG. 3). Coating 31 is preferably a chrome carbide hard coat such as CODEP.

It will also be understood that the swirl angle of swirler 19 may be reduced to lower the momentum in water droplet and impingement intensify. Normally, the swirl angle is set at approximately 37°, but this will preferably be altered to approximately 20°. This is done by providing an insert or partition (not shown) in swirler 19 so that air flow into venturi 22 is set at the desired angle. In this way, the erosion effects of water impingement may be reduced while still allowing proper swirling action.

Figure 4:
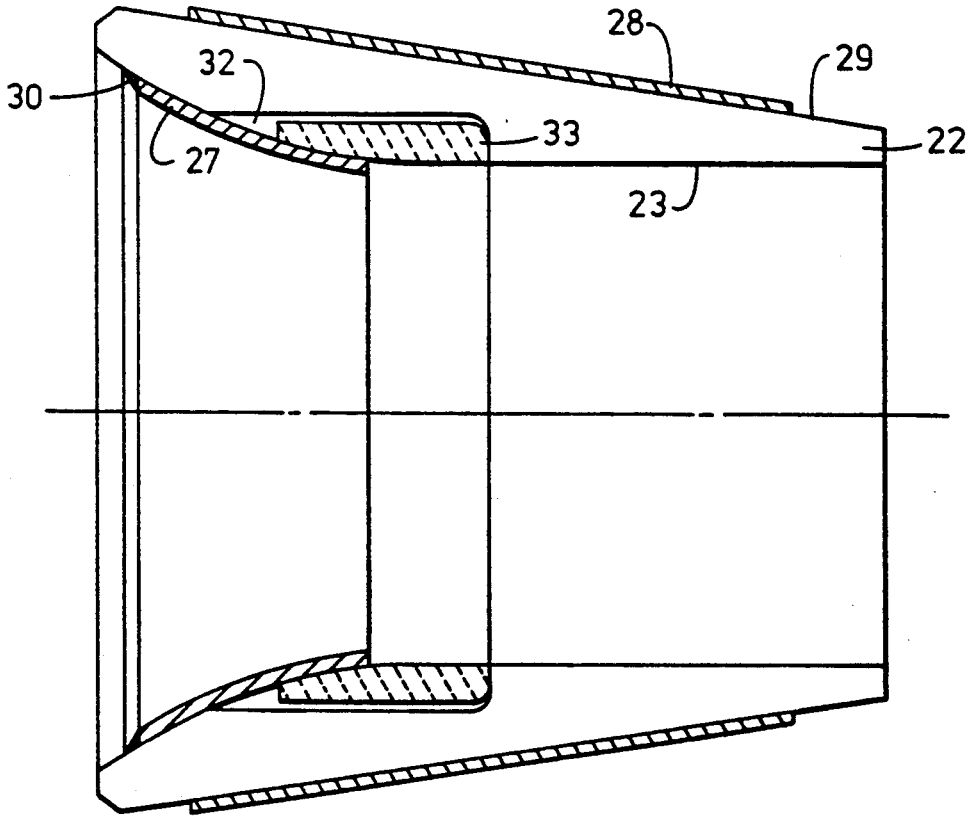
FIG. 4 is an enlarged longitudinal sectional view of an alternate embodiment of the venturi of the present invention.

In an alternative embodiment of the present invention, venturi 22 is illustrated in FIG. 4 as having an area 32 cut away from inner surface 23. With respect to this configuration, an insert 33 is placed within area 32 where it is held in place by heat shield 27. It will be noted that while insert 33 is held "captive" within area 32 it is allowed to float therein due to appropriate contouring and sizing.

Insert 33 is essentially ring-shaped and preferably made of industrial diamond-coated molybdenum or some other suitable metal or ceramic composite having similar characteristics. Insert 33 is of an appreciable thickness (on the order of 1.8 millimeters), which of course is limited by the size of area 32. By being "isolated" physically and thermally from the adjoining hot metal structure, insert 33 is cooled to a uniform (low) temperature and corresponding low gradient with the accompanying benefits thereof described hereinabove. Having shown and described the preferred embodiment of the present invention, further adaptations of the combustor dome for preventing water impingement on the swirl cup can be accomplished by appropriate modifications by one of ordinary skill in the art without departing from the scope of the invention.

I claim:

1. A combustion apparatus for a gas turbine engine, comprising:
   (a) a combustor structure including at least one combustion chamber;
   (b) a dual cone fuel nozzle for injecting both fuel and water to said combustion chamber; and
   (c) a swirl cup package upstream of and adjacent said combustion chamber, said swirl cup package including a swirler, a swirl cup, a splashplate and a venturi extending between said nozzle and said combustion chamber for mixing said fuel and water with air, said venturi having means for reducing the temperature gradient of said venturi.

2. The combustion apparatus of claim 1, wherein said temperature gradient reducing means is a heat shield along the inner surface of said venturi.

3. The combustion apparatus of claim 2, wherein said temperature gradient reducing means includes a heat shield along the outer surface of said venturi.

4. The combustion apparatus of claim 2, wherein said temperature gradient reducing means includes a thermal barrier coating along the outer surface of said venturi.

5. The combustion apparatus of claim 2, wherein a coating is provided between said heat shield and said inner surface of said venturi.

6. The combusion apparatus of claim 2, wherein said heat shield is welded at the venturi's upstream end and extends only partially along said inner surface to a point where fuel and water injected by said nozzle initially strikes the venturi inner surface due to swirling action.

7. The combustion apparatus of claim 1, wherein said temperature gradient of the venturi is reduced to approximately 2000 degrees Fahrenheit per inch or less.

8. The combustion apparatus of claim 1, wherein said nozzle is adjacent an upstream end of said venturi and spaced from said combustion chamber by the length of said venturi.

9. A combustion apparatus for a gas turbine engine, comprising:
   (a) a combustor structure including at least one combustion chamber;

(b) a dual cone fuel nozzle for injecting both fuel and water to said combustion chamber; and (c) a swirl cup package upstream of and adjacent said combustion chamber, said swirl cup package including a swirler, a swirl cup, a splashplate, and a venturi extending between said nozzle and said combusion chamber for mixing said fuel and water with air, said venturi having an area along its inner surface where an insert is retained to reduce the temperature gradient of said venturi.

10. The combustion apparatus of claim 9, wherein said insert is retained in said area by a heat shield.

11. The combustion apparatus of claim 9, wherein said insert is substantially ring shaped.

12. The combustion apparatus of claim 9, wherein said insert is allowed to float within said area o said venturi.

13. The combustion apparatus of claim 9, wherein said area is located at the upstream end of said venturi's inner surface.

14. The combustion apparatus of claim 9, wherein said nozzle is adjacent an upstream end of said venturi and spaced from said combustion chamber by the length of said venturi.

15. The combustion apparatus of claim 1, wherein said temperature gradient of the venturi is reduced to approximately 1500 degrees Fahrenheit per inch or less.

16. The combustion apparatus of claim 1, wherein said temperature gradient of the venturi is reduced by approximately 1000 degrees Fahrenheit per inch.

* * * * *